US010086611B2

(12) United States Patent
Makise

(10) Patent No.: US 10,086,611 B2
(45) Date of Patent: Oct. 2, 2018

(54) INKJET HEAD AND PRINTER

(71) Applicant: KYOCERA Corporation, Kyoto-shi, Kyoto (JP)

(72) Inventor: Keisuke Makise, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/112,112

(22) PCT Filed: Jul. 29, 2015

(86) PCT No.: PCT/JP2015/071448

§ 371 (c)(1),
(2) Date: Jul. 15, 2016

(87) PCT Pub. No.: WO2016/017665

PCT Pub. Date: Feb. 4, 2016

(65) Prior Publication Data

US 2017/0320324 A1 Nov. 9, 2017

(30) Foreign Application Priority Data

Jul. 30, 2014 (JP) ..... 2014-154759

(51) Int. Cl.
*B41J 2/045* (2006.01)
*B41J 2/14* (2006.01)
*B41J 2/16* (2006.01)

(52) U.S. Cl.
CPC ..... *B41J 2/14233* (2013.01); *B41J 2/04533* (2013.01); *B41J 2/14209* (2013.01);
(Continued)

(58) Field of Classification Search
None
See application file for complete search history.

(56) References Cited

U.S. PATENT DOCUMENTS 6,089,701 A * 7/2000 Hashizume ..... B41J 2/14233 347/70
2003/0112298 A1 6/2003 Sato et al.
(Continued)

FOREIGN PATENT DOCUMENTS

EP 1657059 A2 5/2006
JP 2003-069103 A 3/2003
(Continued)

OTHER PUBLICATIONS

International Search Report, PCT/JP2015/071448, dated Oct. 27, 2015, 2 pgs.
(Continued)

*Primary Examiner* — Erica Lin
(74) *Attorney, Agent, or Firm* — Volpe and Koenig, P.C.

(57) ABSTRACT

The head has a passage member having a nozzle and a pressurizing chamber which is communicated with the nozzle and is positioned on the side opposite to the side where the nozzle is opened, a piezoelectric actuator substrate which is superimposed on the passage member so as to cover the pressurizing chamber, and a flexible printed circuit which faces the piezoelectric actuator substrate from the opposite side to the passage member. The piezoelectric actuator substrate has a piezoelectric body which is exposed on the flexible printed circuit side. The piezoelectric body has a via hole opened toward the flexible printed circuit and has a projection portion at the edge part of the via hole which projects to the flexible printed circuit side.

19 Claims, 9 Drawing Sheets

(52) U.S. Cl.
CPC ..... *B41J 2/161* (2013.01); *B41J 2/1623* (2013.01); *B41J 2/04568* (2013.01); *B41J 2/1433* (2013.01); *B41J 2002/14258* (2013.01); *B41J 2002/14266* (2013.01); *B41J 2002/14411* (2013.01)

(56) References Cited

U.S. PATENT DOCUMENTS

| | | | | |
|---|---|---|---|---|
| 2004/0130594 | A1* | 7/2004 | Watanabe | B41J 2/14209 347/40 |
| 2005/0237350 | A1* | 10/2005 | Aoki | B41J 2/04541 347/9 |
| 2006/0066676 | A1 | 3/2006 | Sanada | |
| 2007/0024679 | A1 | 2/2007 | Katayama | |
| 2008/0157628 | A1* | 7/2008 | Sugahara | B41J 2/14233 310/311 |
| 2008/0180490 | A1 | 7/2008 | Murata | |
| 2011/0226807 | A1 | 9/2011 | Essen et al. | |

FOREIGN PATENT DOCUMENTS

| | | | |
|---|---|---|---|
| JP | 2006-102980 | A | 4/2006 |
| JP | 2008-179095 | A | 8/2008 |
| JP | 2010-105317 | A | 5/2010 |
| JP | 2011-194889 | A | 10/2011 |
| JP | 2012-131180 | A | 7/2012 |
| JP | 2014-188716 | A | 10/2014 |

OTHER PUBLICATIONS

Japanese Office Action with English concise explanation, Japanese Patent Application No. 2016-504228, dated Apr. 5, 2016, 6 pgs.
Extended European Search Report, European Application No. 15827276.5, dated Mar. 27, 2018, 8 pgs.

* cited by examiner

INKJET HEAD AND PRINTER

TECHNICAL FIELD

The present invention relates to an inkjet head and a printer.

BACKGROUND ART

Known in the art is a piezo-type inkjet head (for example, Patent Literature 1). This type of inkjet head has a passage member in which a passage for ink is formed, a piezoelectric actuator substrate superimposed on the passage member, and a flexible printed circuit covering the surface of the piezoelectric actuator substrate on the side opposite to the passage member. The passage member has a nozzle for ejecting ink and a pressurizing chamber which is communicated with the nozzle and is opened on the opposite side to the opening direction of the nozzle. The piezoelectric actuator substrate closes the pressurizing chamber, bends into the pressurizing chamber due to an inverse piezoelectric effect when voltage is applied, and gives a pressure to the ink in the pressurizing chamber. Due to this, the ink is ejected from the nozzle. The flexible printed circuit electrically mediates between the piezoelectric actuator substrate and a driver driving and controlling the piezoelectric actuator substrate.

CITATION LIST

Patent Literature

Patent Literature 1. Japanese Patent Publication No. 2010-105317A

SUMMARY OF INVENTION

Technical Problem

In the configuration as described above, the piezoelectric actuator substrate and the flexible printed circuit covering this are liable to dynamically interfere. For example, the load of the flexible printed circuit is liable to be added to the piezoelectric actuator substrate, and this load is liable to exert an effect upon deflection by the inverse piezoelectric effect in the piezoelectric actuator substrate. Further, for example, the flexible printed circuit is liable to vibrate due to the operation of the piezoelectric actuator substrate and strange noise unpleasant to the user is liable to be generated.

Accordingly, desirably there is provided an inkjet head capable of reducing interference between a piezoelectric actuator substrate and a flexible printed circuit.

Solution to Problem

An inkjet head according to one aspect of the present invention has a passage member having a nozzle and a pressurizing chamber which is communicated with the nozzle and is positioned on the opposite side to the side at which the nozzle is opened, a piezoelectric actuator substrate which is superimposed on the passage member so as to cover the pressurizing chamber, and a flexible printed circuit which faces the piezoelectric actuator substrate from the side opposite to the passage member. The piezoelectric actuator substrate has an insulation layer which is exposed on the flexible printed circuit side. The insulation layer has a via hole opened toward the flexible printed circuit and has a projection portion which projects to the flexible printed circuit side at the edge part of the via hole.

A printer according to an aspect of the present invention is provided with the above inkjet head, a scanning portion which makes media and the inkjet head move relative to each other and a control part which controls the inkjet head.

Advantageous Effects of Invention

According to the above configuration, interference between the piezoelectric actuator substrate and the flexible printed circuit can be reduced.

DESCRIPTION OF EMBODIMENTS

Figure 1:
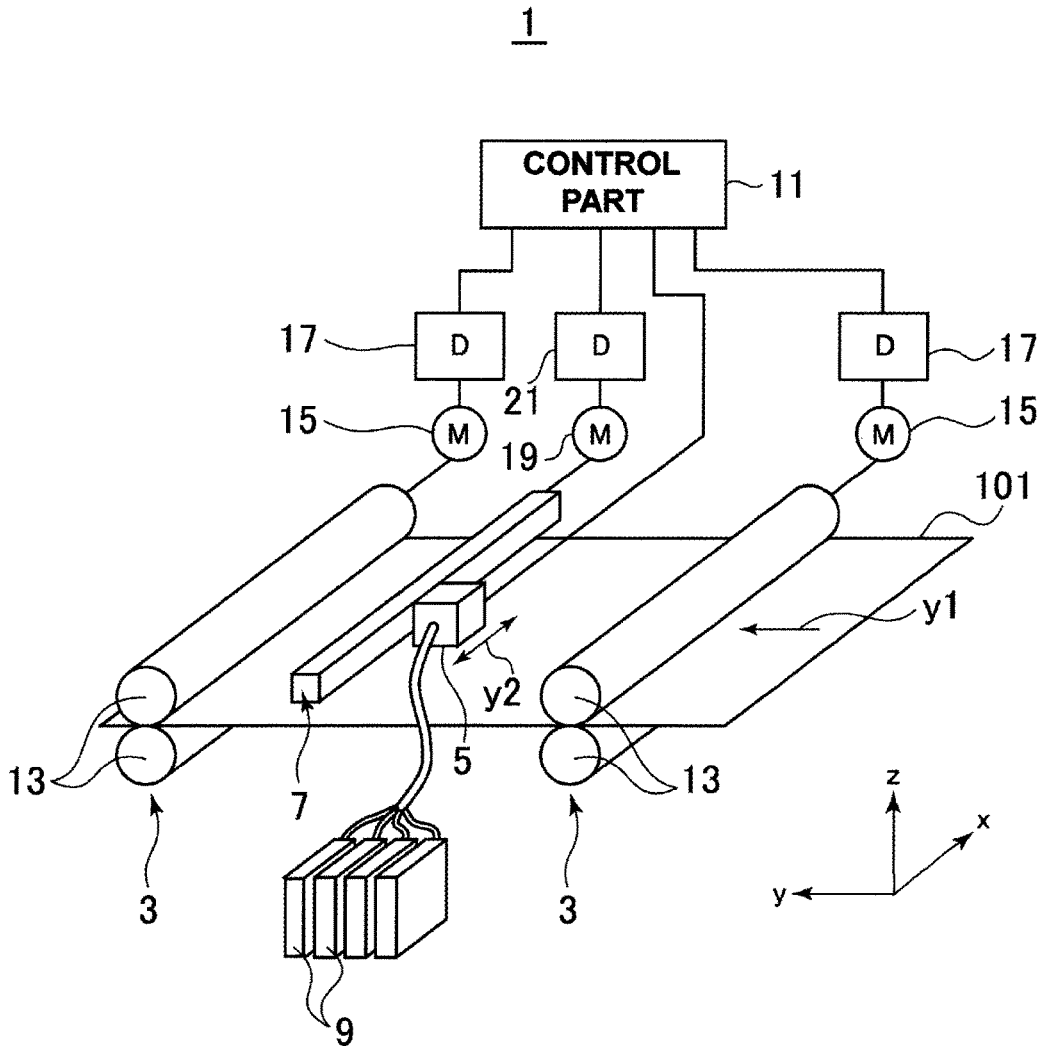
FIG. 1 A perspective view substantially showing principal parts of a printer according to an embodiment of the present invention.

FIG. 1 is a perspective view substantially showing principal parts of a printer 1 according to an embodiment of the present invention.

The printer 1 is an inkjet printer. More specifically, for example, the printer 1 is a piezo-head type, serial head type, and off-carriage type color printer. Note that, the printer 1 may realize a colored image by inks of a suitable number of colors. In the present embodiment, however, the color image is realized by inks of four colors (black, yellow, magenta, and cyan).

The printer 1 for example has conveying portions 3 which convey media (for example paper) 101 to a conveyance direction indicated by an arrow y1, a head 5 which ejects ink drops toward the media 101 which are being conveyed, a scanning portion 7 which makes the head 5 reciprocally move in a sub-scanning direction (arrow y2) which is perpendicular to the conveyance direction of the media 101, ink cartridges 9 for supplying inks to the head 5, and a control part 11 which controls the operation of the printer 1 including an ejection operation of inks from the head 5.

Ink drops are ejected from the head 5 to a medium 101 repeatedly within a range broadened to main scanning direction perpendicular to the sub-scanning direction while the scanning portion 7 is making the head 5 reciprocally move. By doing this, a belt-like two-dimensional image is formed on the medium 101. Further, by intermittent conveyance of the medium 101 by the conveying portions 3, the belt-like two-dimensional images are connected and a continuous two-dimensional image is formed on the medium 101.

The conveying portions 3 for example convey a plurality of media 101 from a not shown supply stack one by one to a not shown delivery stack. The conveying portions 3 may be given a known suitable configuration. FIG. 1 exemplifies conveying portions 3 wherein the conveyance path is made to straight path and having rollers 13 abutting against the media 101, motors 15 rotating the rollers 13, and drivers 17 giving driving electrical power to the motors 15.

The scanning portion 7 may be given a known suitable configuration. For example, the scanning portion 7 has a not shown guide rail which supports a not shown carriage on which the head 5 is mounted so that the carriage can be guided in the sub-scanning direction, a not shown belt fixed to the carriage, a not shown pulley over which the belt is bridged, a motor 19 rotating the pulley, and a driver 21 giving driving electrical power to the motor 19.

The ink cartridges 9 are provided in a place different from that for the head 5 (so that the ink cartridges 9 will not move together with the head 5). The ink cartridges 9 are connected through flexible tubes to the head 5. A plurality of (four in the present embodiment) ink cartridges 9 are provided corresponding to the number of colors of ink ejected by the head 5.

The control part 11 includes for example a CPU, ROM, RAM, and external memory device. The control part 11 outputs control signals to the drivers 17 of the conveying portions 3, the driver 21 of the scanning portion 7, and a driver (which will be explained later) of the head 5 and controls operations of the conveying portions 3, scanning portion 7, and head 5.

Figure 2:
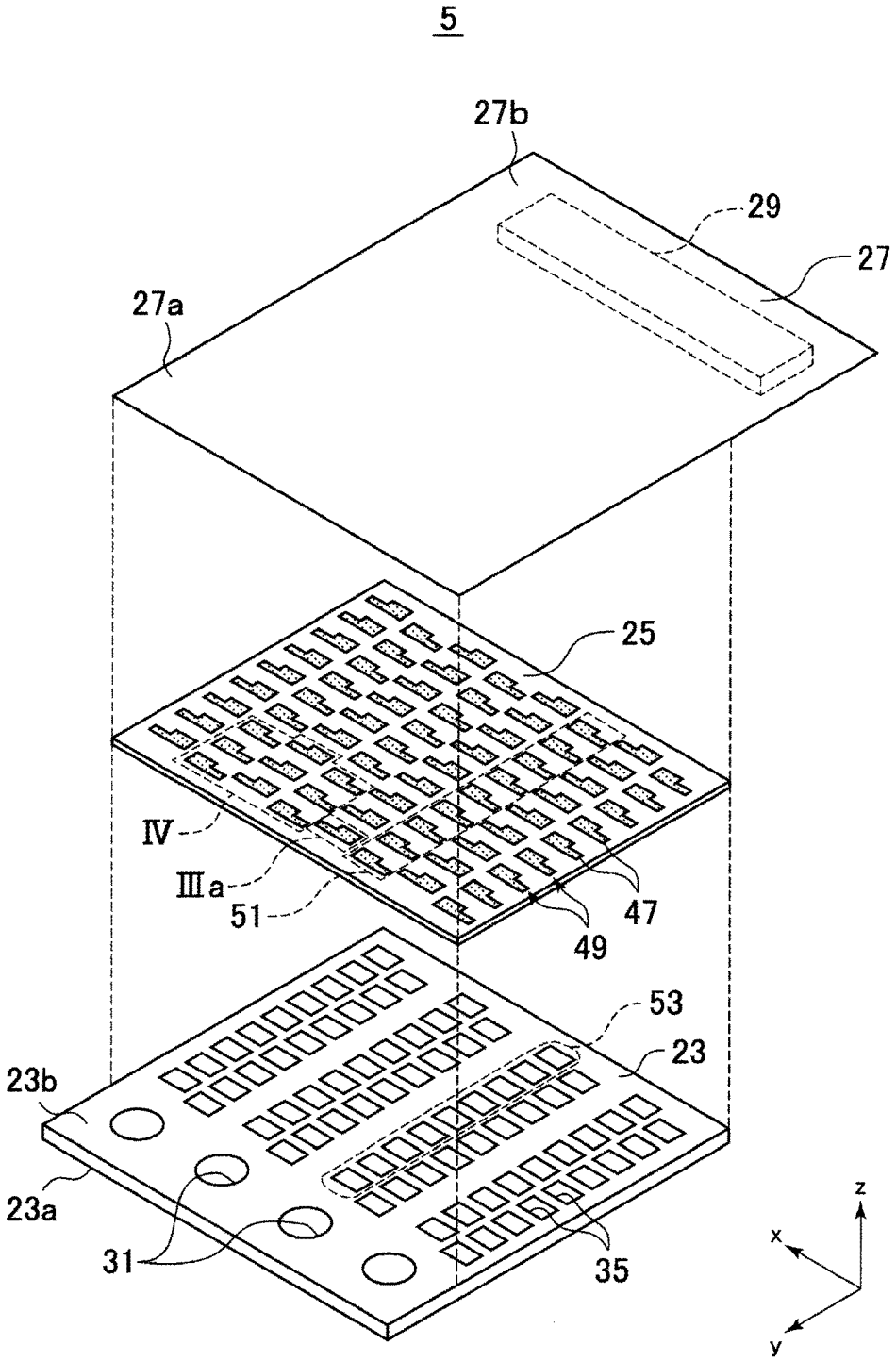
FIG. 2 A disassembled perspective view substantially showing a portion of an inkjet head of the printer in FIG. 1.

FIG. 2 is a disassembled perspective view showing a portion of the head 5. Note that, the lower part on the drawing (negative side of the z-direction) in FIG. 2 is the media 101 side.

The head 5 has a passage member 23 configuring passages of inks, a piezoelectric actuator substrate 25 which generates driving power for ejecting inks from the passage member 23, an FPC (flexible printed circuit) 27 which is electrically connected to the piezoelectric actuator substrate 25, and a driver IC 29 for performing driving and controlling the piezoelectric actuator substrate 25 through the FPC 27.

The passage member 23 is for example substantially formed in a thin rectangular plate state and has a first major surface 23*a* facing the media 101 and a second major surface 23*b* of the back surface of the same. At the first major surface 23*a*, for ejecting ink drops, a plurality of nozzles which will be explained later are opened. Further, at the end part of the second major surface 23*b*, an ink supply port 31 to which the ink is supplied is formed for each color.

The piezoelectric actuator substrate 25 is for example formed in a substantially thin rectangular plate state and is superimposed on the second major surface 23*b* of the passage member 23. The piezoelectric actuator substrate 25 is for example formed to a size large enough to cover the majority of the second major surface 23*b* (portion excluding region of arrangement for the plurality of ink supply ports 31).

The FPC 27 for example has a facing portion 27*a* covering the piezoelectric actuator substrate 25 and an extension part 27*b* which extends outward from the facing portion 27*a* toward the outside of the piezoelectric actuator substrate 25. Note that, the extension part 27*b* may be provided in either of the main scanning direction or sub-scanning direction as well.

The driver IC 29 is for example mounted on the extension part 27*b*. Note that, the driver IC 29 may be arranged at a suitable position by bending the FPC 27. Further, two extension parts may be provided on the FPC 27, and a driver IC 29 may be provided on each of these two extension parts (two driver ICs 29 may be provided in total).

Figure 3A:
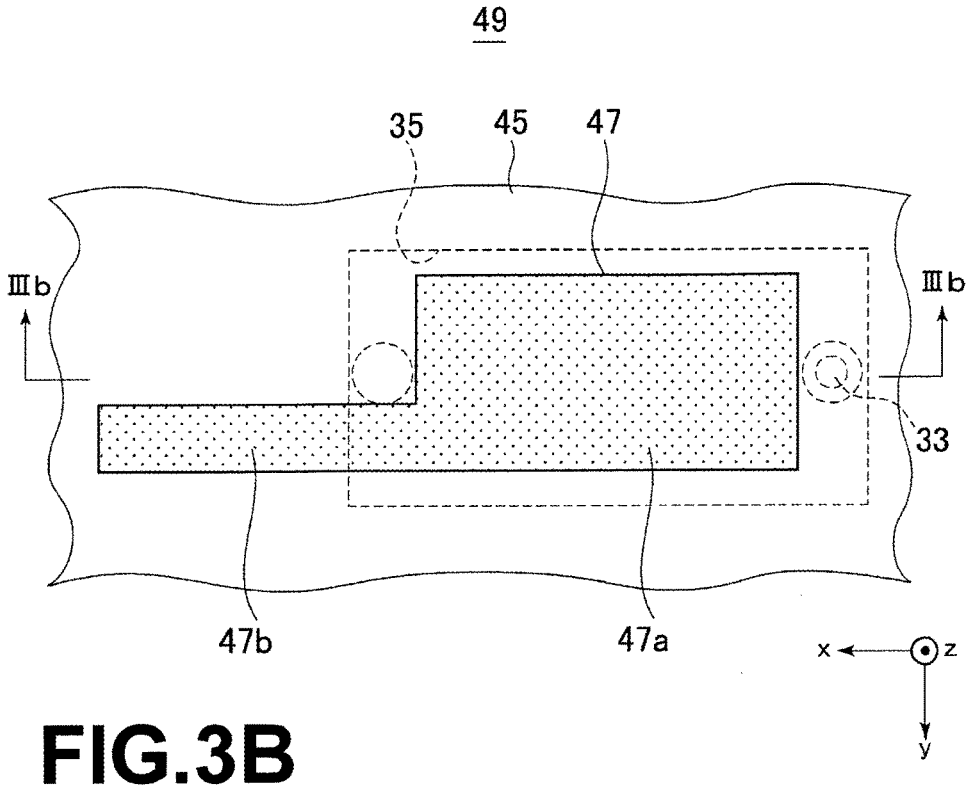
FIG. 3A is a plan view in a region IIIa in FIG. 2.
Figure 3B:
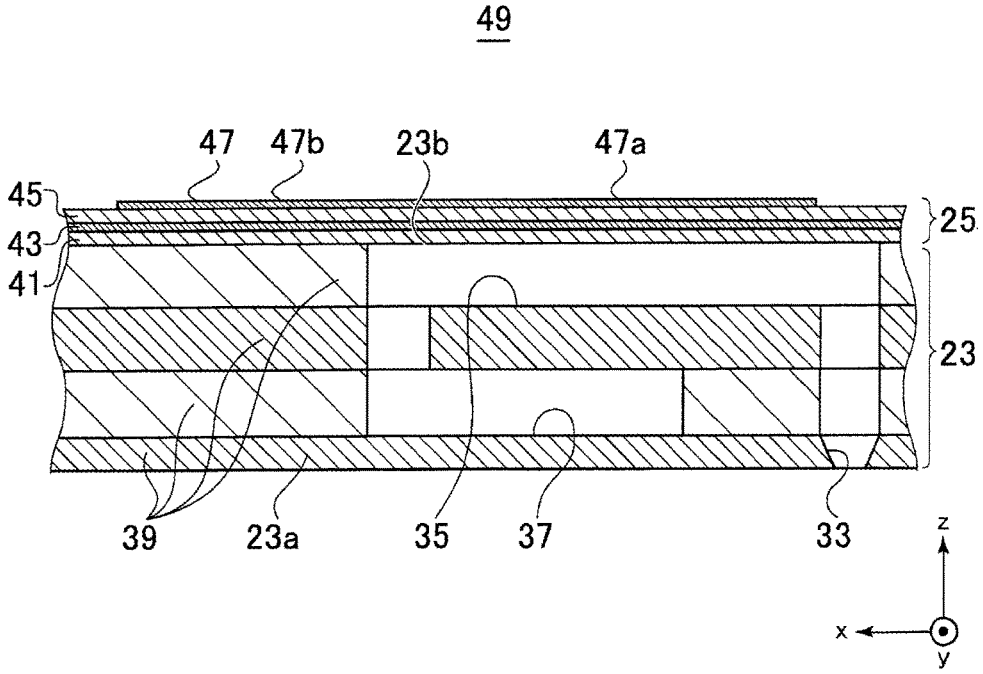
FIG. 3B is a cross-sectional view taken along the IIIb-IIIb line in FIG. 3A.

FIG. 3A is an enlarged plan view showing the passage member 23 and piezoelectric actuator substrate 25 in a region corresponding to the region IIIa in FIG. 2, and FIG. 3B is a cross-sectional view taken along the IIIb-IIIb line in FIG. 3A.

As already explained, the passage member 23 has a plurality of nozzles 33 opened in the first major surface 23*a*. Further, the passage member 23 has a plurality of pressurizing chambers 35 (see FIG. 2 as well) which are communicated with the plurality of nozzles 33 and are opened at the second major surface 23*b* side and has a common passage 37 (FIG. 3B) for supplying inks from the ink supply ports 31 to the plurality of pressurizing chambers 35.

Note that, the concrete shapes may be suitably set. For example, as shown in the present embodiment, the planar shape of a pressurizing chamber 35 may also be roughly rectangular with a nozzle 33 connected to the center of a short side. Further, for example, the planar shape of a pressurizing chamber 35 may also be diamond shape with a nozzle 33 connected to a corner portion or may be an oval or elliptical shape with a nozzle 33 connected to a semicircular shape end part.

The passage member 23 is for example configured by stacking a plurality of plate-shaped members 39 in the z-direction. The plurality of plate-shaped members 39 is formed with via holes or grooves which become the passages. The plurality of plate-shaped members 39 are for example made of a metal. Note that, the plate-shaped member 39 configuring the first major surface 23*a* may be configured by a resin, while the other plate-shaped members 39 may be configured by a metal and so on.

The piezoelectric actuator substrate 25 is for example configured by a unimorph type piezoelectric actuator substrate and is configured by, from the passage member 23 side, an elastic body 41, a common electrode 43, a piezoelectric body 45, and a plurality of individual electrodes 47 (see FIG. 2 as well) stacked in that order. Note that, all of them are formed in layer shapes (plate shapes).

The elastic body 41 configures the upper surfaces of the plurality of pressurizing chambers 35. When voltage is applied between the individual electrodes 47 and the common electrode 43, the piezoelectric body 45 contracts in the surface direction according to the inverse piezoelectric effect. Due to this, the elastic body 41 warps to the pressurizing chamber 35 side. By utilization of this action, pressure is given to the inks in the pressurizing chambers 35, and ink drops are ejected from the nozzles 33.

The elastic body 41, common electrode 43, and piezoelectric body 45 are provided over the plurality of pressurizing chambers 35 as a whole. On the other hand, an individual electrode 47 is provided for each pressurizing chamber 35. To the common electrode 43, for example, a reference potential is given. To the plurality of individual electrodes 47, a potential (driving signal) which is different from that for the common electrode 43 is selectively given. Due to this, the ink drops are selectively ejected from the plurality of nozzles 33.

Each of the plurality of individual electrodes 47 has an electrode body 47*a* which is superimposed over substantially the entirety of the pressurizing chamber 35 and is for applying voltage to the piezoelectric body 45 and has a leadout electrode 47*b* for connection with the FPC 27. The electrode body 47*a* is for example given a shape roughly the same as (resembling) the planar shape of the pressurizing chamber 35. In the present embodiment, the electrode body 47*a* is rectangular and is smaller than the pressurizing chamber 35. The leadout electrode 47*b* extends outward from the electrode body 47*a* to a suitable direction. For example, the leadout electrode 47*b* extends outward to the side opposite to the nozzle 33 with respect to the electrode body 47*a* and up to the position where it is not superimposed on the pressurizing chamber 35.

Note that, below, in the passage member 23 and piezoelectric actuator substrate 25 shown in FIGS. 3A and 3B, the portion corresponding to one nozzle 33 (substantially a region of arrangement of a pressurizing chamber 35 and an individual electrode 47 when viewed by a plan view) will be sometimes referred to as an "ejection element 49".

As shown in FIG. 2, the plurality of ejection elements 49 are arranged in the main scanning direction and sub-scanning direction. Specifically, for example, this is as follows.

Each of the plurality of ejection elements 49 is arranged so that the direction in which the nozzle 33 is arranged with respect to the pressurizing chamber 35 and in which the leadout electrode 47*b* extends with respect to the electrode body 47*a* is matched with the sub-scanning direction (x-direction).

In the row of ejection elements 49 (ejection element row 51) configured by arrangement of a plurality of ejection elements 49 in the main scanning direction (y-direction), the plurality of ejection elements 49 are given the same orientations as each other. Between the ejection element rows 51 which are adjacent to each other, orientations of the nozzles 33 (leadout electrodes 47*b*) are made inverse to each other. Further, they are arranged offset from each other in the scanning direction by a size half of the ejection element 49 in the main scanning direction.

Two ejection element rows 51 with the nozzle 33 sides facing each other correspond to one ink. In the present embodiment, eight ejection element rows 51 in total are provided corresponding to four colors. Note that, the number of the ejection element rows 51 may be different for each color. For example, the number of ejection element rows 51 may be made larger for black ink.

Note that, as apparent from the fact that a plurality of ejection elements 49 configure a plurality of ejection element rows 51, a plurality of pressurizing chambers 35 are arranged in the main scanning direction (y-direction) to configure a pressurizing chamber row 53 (FIG. 2) and the plurality of pressurizing chamber rows 53 are aligned in the sub scanning direction (x-direction).

Figure 9:
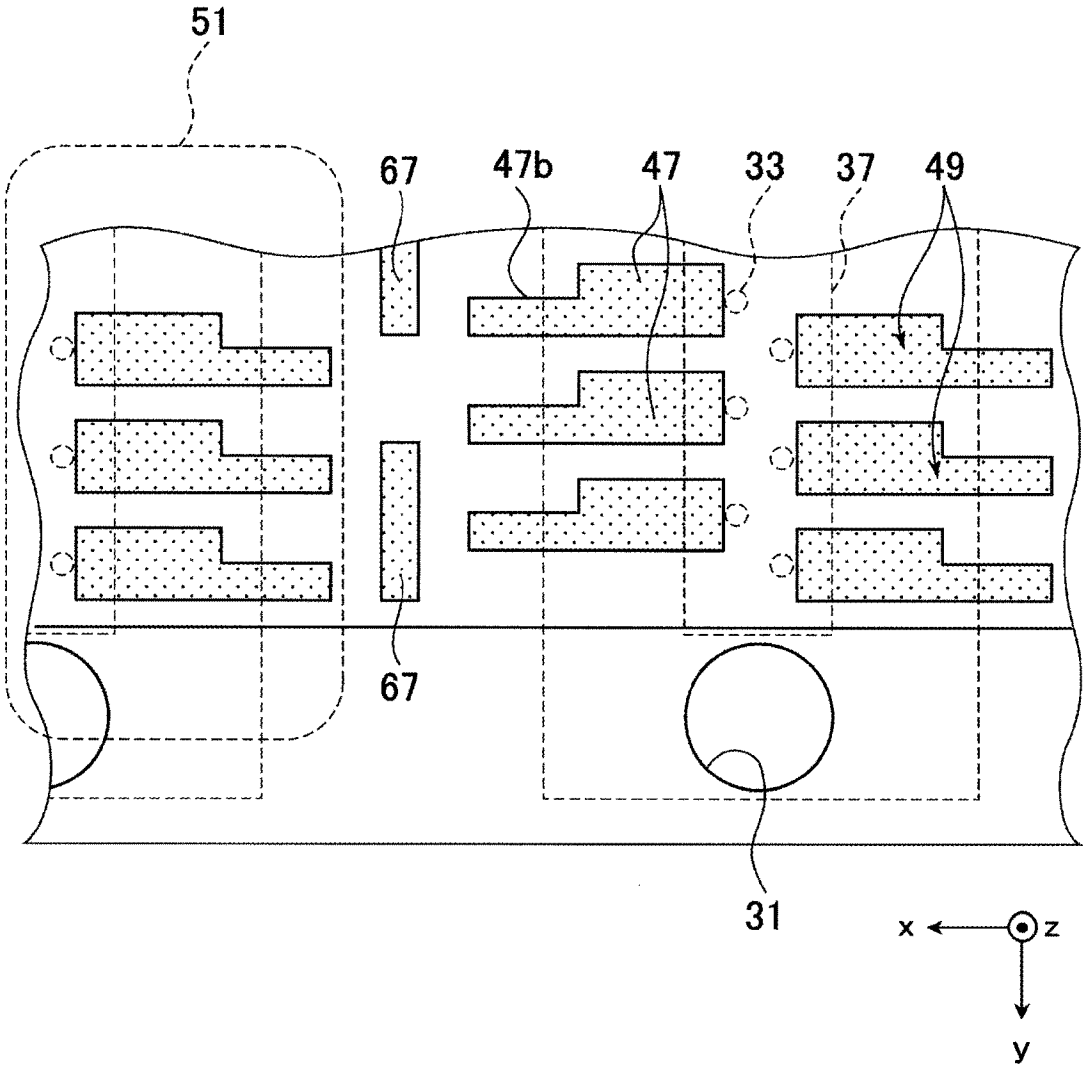
FIG. 9 A plan view showing another modification of the piezoelectric actuator substrate.

The common passage 37 is connected to the ink supply ports 31 and extends along the ejection element rows 51 (see FIG. 9 though it is a view of a modification).

The driver IC 29 shown in FIG. 2 is electrically connected through the FPC 27 to the plurality of individual electrodes 47 and common electrode 43. To the driver IC 29, for example, data of the amount of ink to be ejected is input from the control part 11 for all nozzles 33 at each predetermined driving period. The driver IC 29 for example gives a reference potential to the common electrode 43 and selectively outputs driving signals having a predetermined waveform to the plurality of individual electrodes 47 based on the input data. Further, the driver IC 29, for example, based on the input data, outputs one of a plurality of driving vibrations which are prepared in advance in the driving period or sets the number of times of outputting the driving signal.

Figure 4:
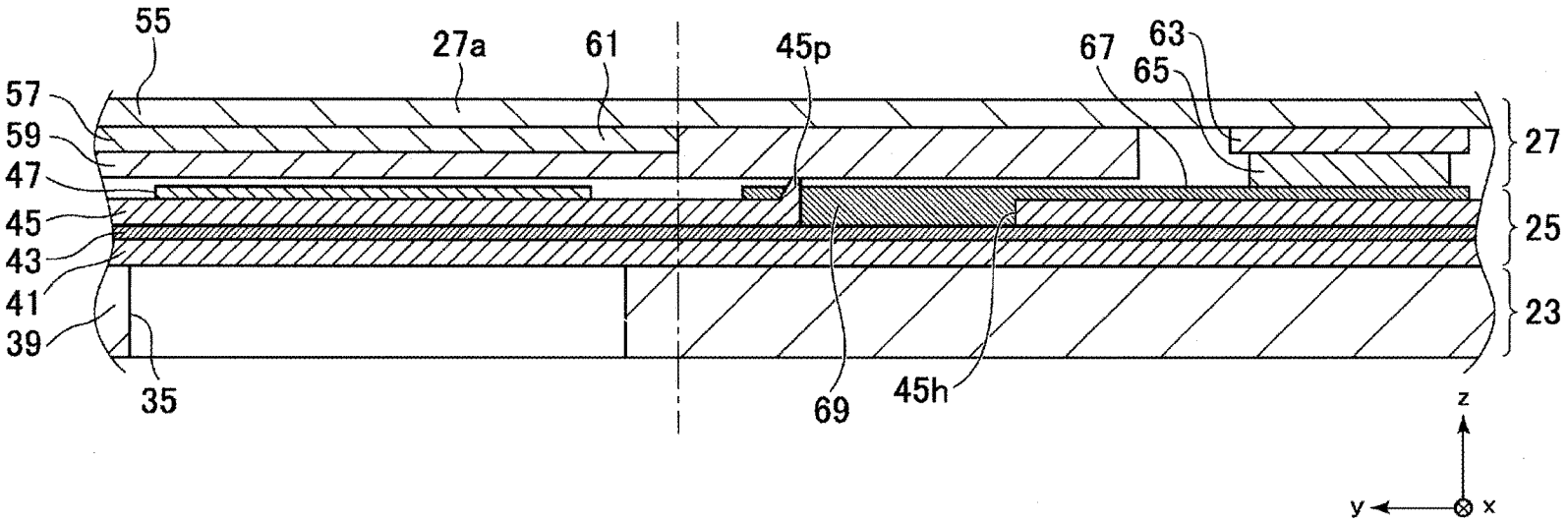
FIG. 4 A cross-sectional view taken along the IV-IV line in FIG. 2.

FIG. 4 is a cross-sectional view taken along the IV-IV line in FIG. 2 for the plate-shaped member 39 in the uppermost layer of the passage member 23, piezoelectric actuator substrate 25, and FPC 27.

The FPC 27 has an insulating base film 55, conductor pattern 57 formed on the base film 55, and an insulation film 59 covering the conductor pattern 57. Further, the facing portion 27*a* of the FPC 27 is arranged so as to make the insulation film 59 side face the piezoelectric actuator substrate 25 side.

The base film 55 is for example made of a flexible resin film. The thickness of the base film 55 is for example about 20 μm to 200 μm. The conductor pattern 57 is for example made of metal such as copper. The thickness of the conductor pattern 57 is for example about 5 μm to 20 μm. The insulation film 59 is for example made of a solder resist. The solder resist is for example made of a thermosetting epoxy resin containing a pigment or the like. The thickness of the insulation film 59 is for example made thicker than the thickness of the conductor pattern 57 by about 5 μm to 20 μm.

The conductor pattern 57 for example includes a plurality of interconnects 61 and not shown plurality of pads for connecting the driver IC 29 and the individual electrodes 47 and includes a not shown one or plurality of interconnects and a plurality of pads 63 for connecting the driver IC 29 and the common electrode 43.

The plurality of interconnects 61, for example, although not particularly shown, extend concurrently (for example in parallel) to each other along the ejection element rows 51 so that they are superimposed on the ejection element rows 51 (pressurizing chamber rows 53) and are bent outward and head toward the leadout electrodes 47*b* in order from the interconnect 61 which is positioned on the outside (lateral side). To the front ends thereof, not shown pads are connected. The pads and the leadout electrodes 47*b* are joined by not shown bumps (however, similar to the bumps 65 explained later).

The plurality of pads 63 are provided on the tips or middles of a not shown plurality of interconnects extending from the driver IC 29 and are joined to the connection patterns 67 of the piezoelectric actuator substrate 25 by the plurality of bumps 65. The thicknesses of the bumps 65 are for example about 5 μm to 20 μm.

The plurality of pads 63 (and plurality of bumps 65) are for example positioned on the periphery of the facing portion 27*a* of the FPC 27 (the periphery of piezoelectric actuator substrate 25).

More specifically, the plurality of pads 63 are arranged along the edge parts in the edge parts on the two sides of the sub-scanning direction (x-direction) of the piezoelectric actuator substrate 25 as understood from the positions of the plurality of connection patterns 67 in FIG. 2. Note, the plurality of pads 63 may be arranged along the edge parts in one, three, or four edge parts of the piezoelectric actuator substrate 25 as well.

Among the not shown interconnects connecting the driver IC 29 and the plurality of pads 63, one interconnect may be connected to a suitable number of pads 63. Further, this one or a plurality of interconnects may be arranged at suitable positions in accordance with the positions of the plurality of pads 63. For example, in the present embodiment, the plurality of pads 63 are positioned at the edge parts of the facing portion 27*a*, therefore one or a plurality of interconnects may extend along the edge parts of the facing portion 27*a*.

A bump 65 shown in FIG. 4 may be formed by a suitable material having conductivity. For example, the bump 65 is comprised of a resin (for example thermosetting resin) containing particles made of metal (for example Ag).

The insulation film 59 covers the plurality of interconnects 61 and not shown one or plurality of interconnects which are connected to the plurality of pads 63. Due to this, short-circuiting of the plurality of interconnects 61 etc. due to adhesion of the conductive material are reduced. Note that, at the insulation film 59, a not shown plurality of pads of the FPC 27, which are joined to the plurality of individual electrodes 47, and the plurality of pads 63 are exposed. Further, the insulation film 59 has a broadness large enough to be superimposed over at least a portion of the pressurizing chambers 35.

The piezoelectric actuator substrate 25, in addition to the configuration explained with reference to FIGS. 3A and 3B, has a plurality of via conductors 69 which are arranged in the plurality of via holes 45*h* formed in the piezoelectric body 45 and are connected to the common electrode 45 and has the plurality of connection patterns 67 explained above which are connected to the plurality of via conductors 69. Accordingly, by connection of the connection patterns 67 to the FPC 27 by the bumps 65, the common electrode 43 is electrically connected to the driver IC 29.

As shown in FIG. 2 and FIG. 4, the plurality of via conductors 69 (plurality of via holes 45*h*) and plurality of connection patterns 67 are for example positioned at the two edge parts of the piezoelectric actuator substrate 25. Note that, as described in the explanation of the plurality of pads 63, the plurality of connection patterns 67 may be positioned at one, three, or four edge parts of the region for arrangement of the plurality of individual electrodes 47 as well. The connection patterns 67 are for example formed so as to extend from the positions on the via conductors 69 to directions along the edge parts of the piezoelectric actuator substrate 25 (y-direction) and are joined to the pads 63 by the bumps 65 at positions which are different from the positions on the via conductors 69.

The connection patterns 67 are for example comprised of the same conductive material as that for the individual electrodes 47 and have the same thickness as the individual electrodes 47. Note that, they may be configured by stacking a plurality of conductive layers as well. Further, the connection patterns 67 and the individual electrodes 47 may be comprised of materials which are different from each other and may be given thicknesses which are different from each other. The planar shapes of the connection patterns 67 may be made suitable ones. For example, the areas may be made broader in a pad state at the portions connected to the via conductors 69 and/or the portions connected to the bumps 65.

The via conductors 69 may be formed by the same conductive material as that for the connection patterns 67 and/or common electrode 43 etc. or may be comprised of a different material. The planar shapes of the via conductors 69 (via holes 45*h*) may be made suitable shapes, for example, circles.

As explained above, the leadout electrodes 47*b* of the individual electrodes 47 and not shown pads of the FPC 27 are joined by not shown bumps. Further, the connection patterns 67 and the pads 63 of the FPC 27 are joined by the bumps 65. Due to this, the piezoelectric actuator substrate 25 and the facing portion 27*a* of the FPC 27 are fastened. Accordingly, the piezoelectric actuator substrate 25 and the facing portion 27*a* face each other in for example a state where the bumps 65 function as spacers.

Specifically, for example, the insulation film 59 of the FPC 27 faces the electrode bodies 47*a* of the individual electrodes 47 and portions of the connection patterns 67 (tops of the via conductors 69 and peripheral portions thereof) at a very small interval or contacts the latter with a relatively low pressure. The size of the very small interval is for example 20 μm or less, or 10 μm or less.

Note that, such a state is for example realized by joining the FPC 27 to the piezoelectric actuator substrate 25 like in the following way. First, on the leadout electrodes 47*b* and connection patterns 67, an uncured material which will form the bumps (for example, a thermosetting resin containing metal particles) is coated. Next, the FPC 27 is coated on the piezoelectric actuator substrate 25, and the FPC 27 is pressed against the piezoelectric actuator substrate 25. At this time, the material which will form the bumps is crushed (deforms) and thus the insulation film 59 contacts or approaches the piezoelectric actuator substrate 25. After that, the material which will form the bumps is thermally cured.

Figure 5A:
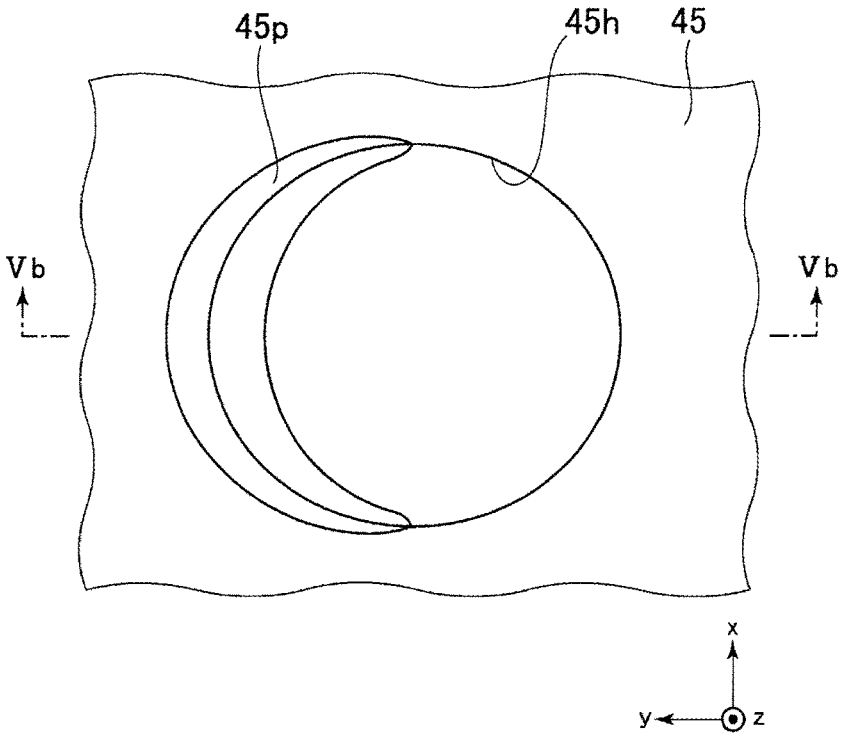
FIG. 5A is a plan view near a via hole of a piezoelectric body.
Figure 5B:
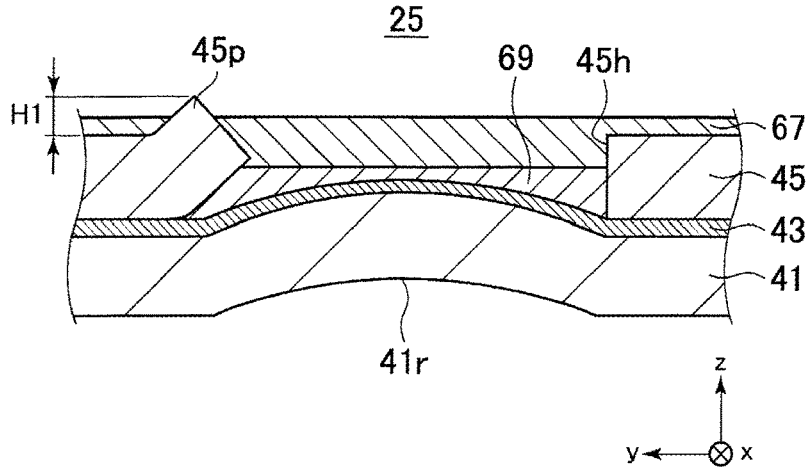
FIG. 5B is a cross-sectional view of a piezoelectric actuator substrate taken along the Vb-Vb line in FIG. 5A.

FIG. 5A is a plan view near a via hole 45*h* of the piezoelectric body 45. FIG. 5B is a cross-sectional view of the piezoelectric actuator substrate 25 taken along the Vb-Vb line in FIG. 5A.

Note that, in FIG. 5B, the material which configures the connection pattern 67 enters into the upper part of the via hole 45*h*. The connection pattern 67 may be defined including this portion entered into the upper part of the via hole 45*h* or may be defined using the surface of the piezoelectric body 45 on the FPC 27 side as the standard (the portion entered into the upper part of the via hole 45*h* may be grasped as a portion of the via conductor 69 as well). Below, for convenience of the explanation, this will be explained according to the former definition.

As shown in FIG. 4, FIG. 5A, and FIG. 5B, the piezoelectric body 45 has a projection portion 45*p* which projects to the FPC 27 side at the edge part of each via hole 45*h*. The height H1 (FIG. 5B) of the projection portion 45*p* from the flat surface of the piezoelectric body 45 is for example larger than the thickness of the individual electrode 47 and the thickness of a portion of the connection pattern 67 on the piezoelectric body 45 (the portion other than a portion on the via conductor 69). Accordingly, the top face of the projection portion 45*p* (the vertex or ridgeline having an extremely small area is also regarded as one type of top face) is positioned nearer to the FPC 27 side than the surface of the individual electrode 47 on the FPC 27 side. Further, the projection portion 45*p* penetrates through the connection pattern 67 and its top face is exposed to the FPC 27 side. Then, the top face of the projection portion 45*p* contacts the FPC 27 (insulation film 59) or faces the latter at a very small interval. The height of the projection portion 45*p* may be suitably set. As one example, this is 5 μm to 10 μm.

As shown in FIG. 5A, the projection portion 45*p* is formed so as to extend along the edge part of the via hole 45*h*. Its length is for example ⅓ the circumference to ⅔ the circumference of the edge part of the via hole 45*h*. FIG. 5A exemplifies a case where the length of the projection portion 45*p* is about a half circumference of the edge part of the via hole 45*h*. The connection pattern 67, when viewed by a plan view, extends from the position superimposed on the via conductor 69 to the outside of the via conductor 69 through a portion in the edge part of the via hole 45*h* where the projection portion 45*p* is not formed. The cross-sectional shape and width etc. of the projection portion 45*p* may be suitably set. In FIG. 5B, the cross-sectional shape is triangular, but may be a dome shape as well.

The common electrode 43 and elastic body 41 are recessed to the via hole 45*h* side at the region at which they are superimposed over a via hole 45*h*. Accordingly, at the surface of the piezoelectric actuator substrate 25 (elastic body 41) on the passage member 23 side (negative side of z-direction), in the region superimposed over the via hole 45*h*, a recessed portion 41*r* is formed. The depth etc. of the recessed portion 41*r* may be suitably set.

Figure 6:
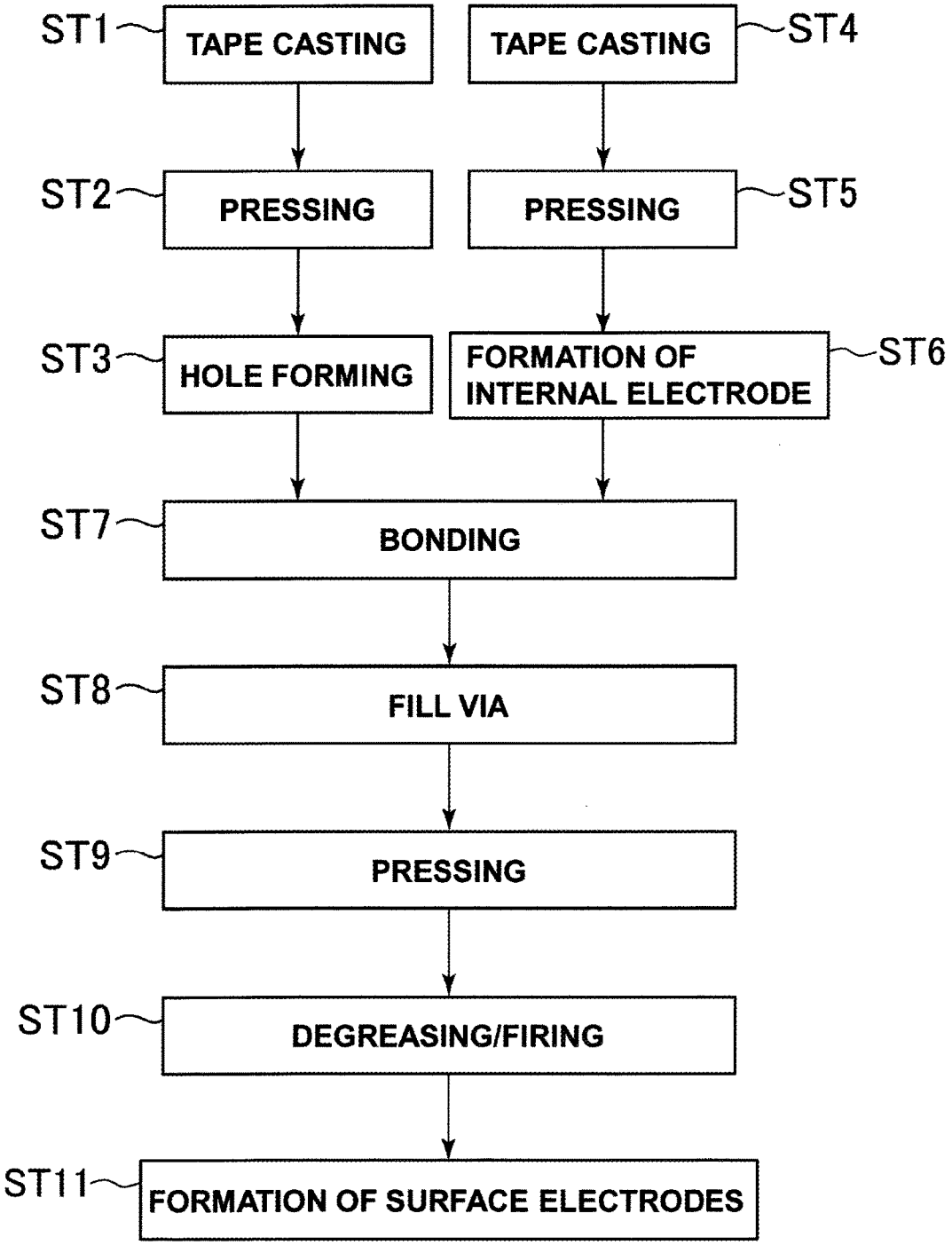
FIG. 6 A flow chart showing a procedure of a method of production of the piezoelectric actuator substrate.
Figure 7A:
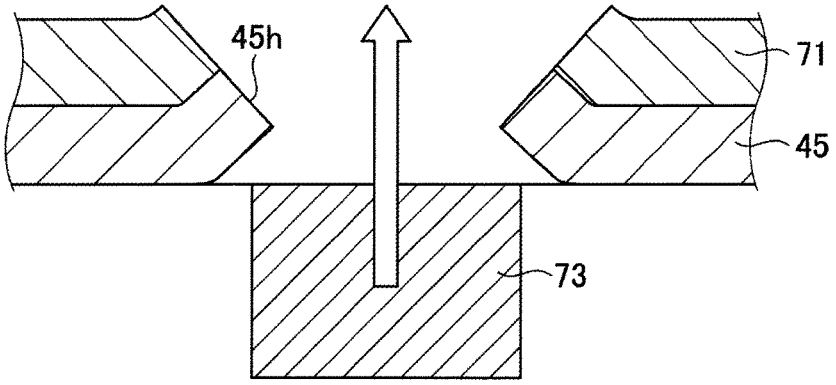
FIG. 7A to FIG. 7C are cross-sectional views for explaining the method of production of the piezoelectric actuator substrate.
Figure 7B:
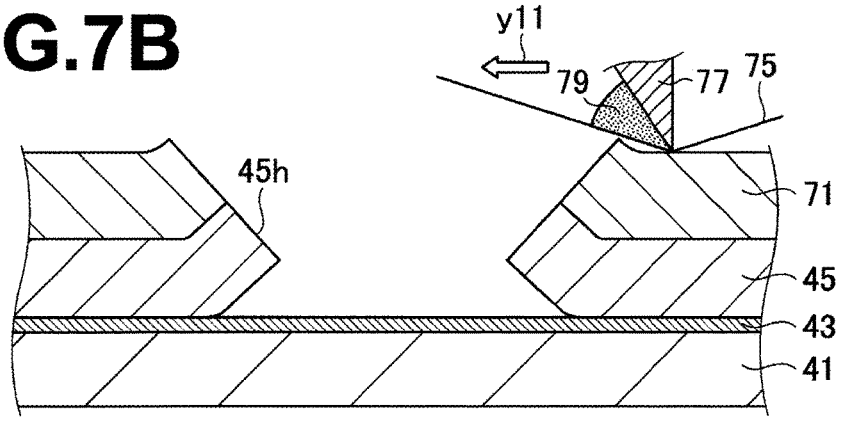
Figure 7C:
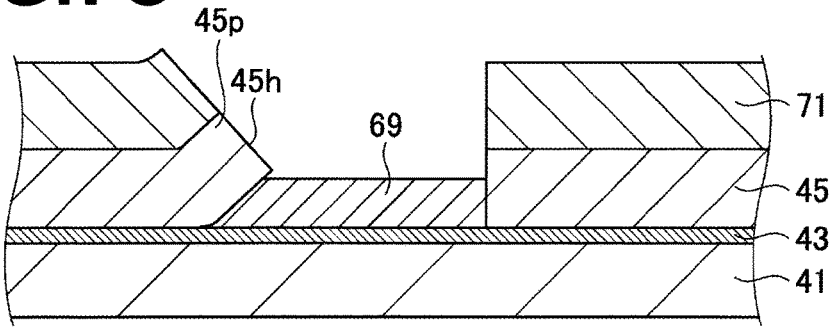

FIG. 6 is a flow chart showing an example of the procedure of the method of production of the piezoelectric actuator substrate 25. FIG. 7A to FIG. 7C are cross-sectional views corresponding to FIG. 5B for explaining the method of production of the piezoelectric actuator substrate. Note that, the states of the materials configuring the parts and shapes of the parts change along with the advance of the manufacturing process. However, for convenience of explanation, the same notations will be sometimes attached before and after the change.

Steps ST1 to ST3 show the manufacturing procedure of the piezoelectric body 45. At step ST1, a ceramic green sheet which will form the piezoelectric body 45 is formed on a tape 71 (FIG. 7A) by tape casting. At step ST2, the tape 71, and green sheet which will form the piezoelectric body 45 are pressed in the lamination direction to adjust the shape of the green sheet.

At step ST3, as shown in FIG. 7A, by punching process (punching), the holes which will form the via holes 45*h* are formed in the green sheet which will form the piezoelectric body 45*a*. At this time, in the green sheet which will form the piezoelectric body 45 and the tape 71, edge parts of holes which will form the via holes 45*h* are turned up (burrs and rollovers occur) in the punching direction. Note that, the punching is for example carried out in the direction from the green sheet side which will form the piezoelectric body 45 to the tape 71 side. Note, the inverse direction to that is also possible.

Steps ST4 to ST6 which are carried out separately from steps ST1 to ST3 show the manufacturing procedure of the elastic body 41 and common electrode 43. At step ST4, a ceramic green sheet which will form the elastic body 41 is formed on a not shown tape by tape casting. At step ST5, the tape and the green sheet which will form the elastic body 41 are pressed in the lamination direction to adjust the shape of the green sheet. At step ST6, a conductive paste which will form the common electrode 43 is coated on the green sheet which will form the elastic body 41 by screen printing or the like.

At step ST7, the green sheet which will form the piezoelectric body 45 and a laminate configured by the green sheet which will form the elastic body 41 and by the conductive paste which will form the common electrode 43 are adhered to each other. At this time, in the green sheet which will form the piezoelectric body 45, the side opposite to the direction where the edge part of the hole which will form the via hole 45*h* is turned up is made the common electrode 43 side (see FIG. 7B).

At step ST8, as shown in FIG. 7B, a conductive paste 79 which will form the via conductors 69 is filled by screen printing in the holes which will become the via holes 45*h*. That is, a printing plate 75 is placed over the piezoelectric body 45, a squeegee 77 is moved to the direction indicated by the arrow y11 while pressing the squeegee 77 against the printing plate 75, and the conductive paste 79 on the printing plate 75 is pushed to the piezoelectric body 45 side above the holes which will become the via holes 45*h*. At this time, the portions of the green sheet 45 other than the via holes 45*h* are covered by the tape 71. Therefore, in order to selectively print the conductive paste 79 at the via hole 45*h* portions, it is also possible to perform printing without using screen printing plate, metal mask, and so on.

At this time, as shown in FIG. 7C, at the edge parts of the holes which will form the via holes 45*h*, the turned up states of the portions (right side on the drawing sheet) which are turned up to the opposite side to the movement direction of the squeegee 77 are corrected. On the other hand, at the portions which are turned up to the movement direction of the squeegee 77, the turned up states are not corrected by the squeegee 77 or even if partially corrected the turned up states are remain. Further, the portions (burrs) in which the turned up states are not corrected and remain configure the projection portions 45*p*. In the case where the holes which form the via holes 45*h* are circular, the turned up portions covering about half the circumference of the edge parts of the holes are not corrected and become the projection portions 45*p*.

At step ST9, the green sheet which will form the elastic body 41, the conductive paste which will form the common electrode 43, and the green sheet which will form the piezoelectric body 45 are pressed in the lamination direction to adjust the shapes. Beneath the portions which will form the projection portions 45*p* (beneath the rollovers) at the green sheet which will form the piezoelectric body 45, conductive paste which will form the via conductors 69 is arranged. Therefore, in the portions which will form the projection portions 45*p*, the turned up states are not corrected or even if partially corrected the turned up states remain. Further, the thickness of the conductive paste which will form the via conductors 69 is thinner than the thickness of the green sheet which will form the piezoelectric body 45 or the total thickness of the green sheet which will form the piezoelectric body 45 and the tape 71, therefore the conductive paste which will form the common electrode 43 and the green sheet which will form the elastic body 41 warp to the hole side which will form the via holes 45*h* and thus the recessed portions 41*r* are formed.

At step ST10, degreasing and firing are carried out. Note that, it is also possible to omit the degreasing. Note that, the tape 71 is peeled off before the degreasing.

At step ST11, the individual electrodes 47, connection patterns 67, and other conductor patterns of the piezoelectric actuator substrate 25 on the FPC 27 side are formed. The conductor patterns are for example formed by printing the conductive paste and firing it. Other than the above description, the formation of the conductor patterns may be carried out by forming a metal film in predetermined patterns by a vapor deposition process through a mask or by etching after forming a metal film on the entire surface by a vapor deposition process. Note that, at the time of formation of the conductor patterns, patterning is carried out so that conductor patterns (connection patterns 67) are not formed on the projection portions 45*p*. When the conductor patterns are formed by printing, it is also possible to keep the upper parts of the projection portions 45*p* from being printed by making the printing thickness thinner than the heights of the projection portions 45*p*. Further, it is also possible to utilize the fact that the general shapes of the projection portions 45*p* are tapered shapes and therefore it is hard for the metal film to adhere onto the projection portions 45*p*.

As described above, in the present embodiment, the head 5 has the passage member 23 having the nozzles 33 and the pressurizing chambers 35 which are communicated with the nozzles 33 and are opened on the side opposite to the side where the nozzles 33 are opened, the piezoelectric actuator substrate 25 which is superimposed on the passage member 23 so as to close the pressurizing chambers 35, and the FPC 27 which faces the piezoelectric actuator substrate 25 from the side opposite to the passage member 23. As the passage member 23, use may be made of one further having a plate-shaped member 39 so as to close the pressurizing chambers 35 on the side where the pressurizing chambers 35 are opened. By arranging the pressurizing chambers 35 on the second major surface 23*b* side in the passage member 23, the pressure generated at the piezoelectric actuator substrate 25 which is arranged so as to cover the pressurizing chambers 35 is transmitted to the pressurizing chambers 35 through the plate-shaped member 39 on the pressurizing chambers 35. Due to such a configuration, for example, the possibility of the solvent etc. of the ink exerting an influence upon the reliability of the piezoelectric actuator substrate 25 can be reduced. The piezoelectric actuator substrate 25 has the piezoelectric body 45 which is exposed to the FPC 27 side. The piezoelectric body 45 has the via holes 45*h* which are opened toward the FPC 27 and has the projection portions 45*p* at the edge parts of the via holes 45*h* which project to the FPC 27 side.

Accordingly, the projection portions 45*p* become spacers, so contact of the FPC 27 to the piezoelectric actuator substrate 25 is suppressed. As a result, for example, the influence of the load of the FPC 27 exerted upon the operation of the piezoelectric actuator substrate 25 is reduced. Further, for example, it becomes easier for air to enter into the space between the piezoelectric actuator substrate 25 and the FPC 27, therefore it is difficult that negative pressure is generated between the FPC 27 and the piezoelectric actuator substrate 25 when the piezoelectric actuator substrate 25 bends to the pressurizing chamber 35 side, so the influence of the negative pressure exerted upon the operation of the piezoelectric actuator substrate 25 is reduced. Further, for example, abnormal noise in the head 5 due to the vibration of the FPC 27 due to the operation of the piezoelectric actuator substrate 25 is suppressed. In this way, dynamic interference between the FPC 27 and the piezoelectric actuator substrate 25 is reduced by the projection portions 45*p*. Further, for example, the projection portions 45*p* contribute also to suppression of too much crushing of the bumps 65 when joining the FPC 27 and the piezoelectric actuator substrate 25.

Vibration of the FPC 27 due to the operation of the piezoelectric actuator substrate 25 more easily occur when the interval of the piezoelectric actuator substrate 25 and the FPC 27 becomes very small. The vibration on the pressurizing chambers 35 in the operation of the piezoelectric actuator substrate 25 is easily transmitted to the FPC 27 in a case where the interval between the individual electrodes 47 and the FPC 27 is the very small interval of 20 μm or less. In such a case, by arranging the projection portions 45*p*, it can be made harder for vibration of the FPC 27 to occur. That is, the projection portions 45*p* more effectively act in a case where the interval between the surfaces of the individual electrodes 47 which face the FPC 27 and the FPC 27 is 20 μm or less, further preferably 10 μm.

Only formation of the projection portions 45*p* at the edge parts of the via holes 45*h* of the piezoelectric body 45 is performed, therefore there is no increase of the number of members etc. and the configuration is simple. Further, it is also possible to form the projection portions 45*p* by utilizing the turned up portions (burrs) occurring when forming the via holes 45*h*, so the manufacturing process is simplified. Usually, such burrs are considered undesirable. However, in the present embodiment, these are utilized for reduction of interference between the FPC 27 and the piezoelectric actuator substrate 25 and so on, therefore the present embodiment is epoch-making.

Further, in the present embodiment, the piezoelectric actuator substrate 25 further has the piezoelectric body 45 and the individual electrodes 47 which are superimposed on the FPC 27 side of the piezoelectric body 45 while avoiding the projection portions 45*p*. The top faces of the projection portions 45*p* are positioned nearer to the FPC 27 side than the surfaces of the individual electrodes 47 which face the FPC 27.

That is, the projection portions 45*p* have sufficient height. Therefore, the interference between the FPC 27 and the piezoelectric actuator substrate 25 which was explained above can be more reliably reduced. Further, the individual electrodes 47 are portions which are positioned on the pressurizing chambers 35 and vibrate, therefore the interference between the FPC 27 and the piezoelectric actuator substrate 25 can be more effectively reduced.

Further, in the present embodiment, the piezoelectric actuator substrate 25 further has the via conductors 69 which are arranged in the via holes 45*h* and connect the conductor layers (common electrode 43 and connection patterns 67) which are arranged at front and back sides of the piezoelectric body 45 to each other.

That is, the via holes 45*h* are formed so as to electrically connect the front and the back sides of the piezoelectric body 45 and are not ones (the ones are included in the invention of the present application as well) provided only for forming the projection portions 45*p* for reducing the interference between the FPC 27 and the piezoelectric actuator substrate 25. Accordingly, the configuration of the piezoelectric actuator substrate 25 is simple, and the method of production is simplified.

Further, in the present embodiment, the projection portions 45*p* are formed over ⅓ the circumference to ⅔ the circumference of the edge parts of the via holes 45*h*.

Accordingly, for example, compared with a case where the projection portions are formed in pin shapes (this case is included in the invention of the present application as well), contact of the projection portions 45*p* with the FPC 27 with a high pressure is suppressed. As a result, breakage of the FPC 27 is suppressed. On the other hand, the connection patterns 67 can extend from the positions on the via holes 45*h* to the outside of the via holes 45*h* through the positions at which the projection portions 45*p* are not arranged. Therefore, compared with a case where the projection portions are formed over the entire circumferences of the via holes 45*h* (this case is included in the invention of the present application as well), electrical connection can be reliably established.

Further, in the present embodiment, the surface of the piezoelectric actuator substrate 25 which is joined to the passage member 23 is recessed at the regions superimposed over the via holes 45*h* (the recessed portions 41*r* are formed).

Accordingly, for example, when adhering the piezoelectric actuator substrate 25 and the passage member 23 to each other, excessive adhesive can be made to retreat to the recessed portions 41*r*. As a result, high precision adhesion is realized, therefore manufacturing variations in performance of the head 5 are reduced.

(Modifications)

Below, modifications will be explained with reference to FIG. 8 and FIG. 9.

Figure 8:
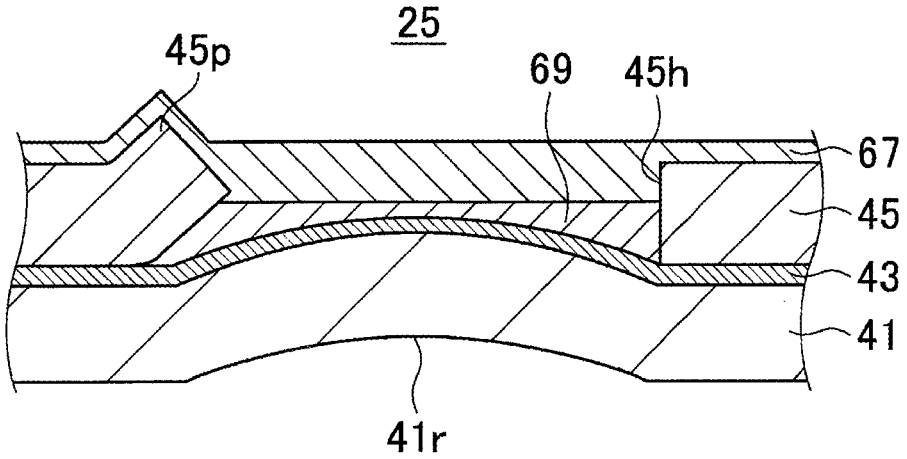
FIG. 8 A cross-sectional view showing a modification of the piezoelectric actuator substrate.

FIG. 8 is a cross-sectional view corresponding to FIG. 5B and shows a modification of the cross-sectional structure around a projection portion 45*p*.

In this modification, a connection pattern 67 covers the projection portion 45*p*. In the connection pattern 67, the thickness of the portion on the projection portion 45*p* is for example substantially equal to the thickness of the portion in the connection pattern 67 which is located on the flat surface of the piezoelectric body 45 and to the thickness of the individual electrode 47. Further, in the connection pattern 67, the top face of the portion on the projection portion 45*p* is positioned nearer to the FPC 27 side than the surface of the individual electrode 47 which faces the FPC 27.

According to the configuration like in this modification as well, in the same way as the embodiments, the projection portions 45*p* and the portions in the connection patterns 67 which are located on the projection portions 45*p* are made to function as spacers, therefore the dynamic interference between the FPC 27 and the piezoelectric actuator substrate 25 can be reduced.

Further, in this modification, compared with the above embodiments, for example, in addition to the projection portions 45*p*, the portions of the connection patterns 67 which are located on the projection portions 45*p* also function as spacers, therefore the spacers can be easily made thicker. From another viewpoint, the heights of the projection portions 45*p* can be made lower. For example, even when the heights of the projection portions 45*p* are smaller than the thicknesses of the individual electrodes 47, the top faces of the connection patterns 67 which are located on the projection portions 45*p* are positioned nearer to the FPC 27 side than the surfaces of the individual electrodes 47, so contact between the FPC 27 and the individual electrodes 47 can be suppressed.

Note that, in a configuration like in the embodiments where the projection portions 45*p* are not covered by the connection patterns 67, compared with the modification, for example, the possibility of unintended electrical connection between the piezoelectric actuator substrate 25 and the FPC 27 can be reduced.

FIG. 9 is a plan view showing a modification of the positions of arrangement of the connection patterns 67 (via holes 45*h*, projection portions 45*p*, via conductors 69, pads 63, and bumps 65).

In this modification, the connection patterns 67 are provided between the ejection element rows 51 (for example on the leadout electrode 47*b* side) in addition to or in place of the edge parts of the piezoelectric actuator substrate 25. More specifically, for example, the connection patterns 67 extend along the ejection element rows 51. Further, a plurality of connection patterns 67 are arranged along the ejection element rows 51. Further, although not particularly shown, the plurality of connection patterns 67 are provided in two or more rows corresponding to the provision of two or more sets (three sets in the example of FIG. 2) each consisting of two ejection element rows 51 in which the leadout electrodes 47*b* are made to face each other.

Note that, although not particularly shown, in the same way as the embodiments, the via holes 45*h* and via conductors 69 are positioned at the end parts on the positive side of the y-direction of the connection patterns 67, the pads 63 and bumps 65 are positioned at the end parts on the negative side of the y-direction of the connection patterns 67, and the projection portions 45*p* are positioned at the edge parts on the positive side of the y-direction of the via holes 45*h*. The not shown interconnects of the FPC 27 which are connected to the pads 63 for example extend along the ejection element rows 51.

According to this modification, the projection portions 45*p* which function as the spacers between the FPC 27 and the upper surface of the piezoelectric actuator substrate 25 (individual electrodes 47 etc.) are not only positioned on the periphery of the piezoelectric actuator substrate 25, but are also positioned between the ejection elements 49, therefore the interference between the FPC 27 and the piezoelectric actuator substrate 25 can be more reliably reduced. Note that, the aspect of providing the connection patterns 67 only on the periphery as in the embodiments is advantageous for reducing the size of the piezoelectric actuator substrate 25.

Note that, in the above embodiments, the piezoelectric body 45 is one example of the insulation layer, the individual electrodes 47 are examples of the external electrodes, the common electrode 43 is one example of the internal electrode, and the common electrode 43 and connection patterns 67 are examples of the front and back conductive layers of the piezoelectric body.

Further, as another modification, the number of layers of the piezoelectric body 45 may be set to two or more as well. In that case, the piezoelectric actuator substrate 25 is comprised of, for example, from the passage member 23 side, the elastic body 41, common electrode 43, piezoelectric body 45, plurality of individual electrodes 47, piezoelectric body 45, common electrode 43, piezoelectric body 45, and plurality of individual electrodes 47 laminated in that order. That is, in this configuration, between the common electrodes 43 and the plurality of individual electrodes 47 which are alternately arranged, three layers of the piezoelectric body 45 are arranged.

The plurality of individual electrodes 47 and the plurality of individual electrodes 47 in another layer are individually electrically connected by the via conductors 69 which are arranged in the via holes 45*h*. The plurality of individual electrodes 47, in both layers, are arranged in the same way as shown in FIG. 2. The via holes 45*h* and via conductors 69 are arranged in the leadout electrodes 47*b* at positions where they are not superimposed over the pressurizing chambers 35. The common electrode 43 which is arranged between the two layers each consisting of the plurality of individual electrodes 47 is arranged while avoiding the via conductors 69 which electrically connect the plurality of individual electrodes 47. Further, the two layers of common electrode 43 are electrically connected by the via conductors 69 arranged in the via holes 45*h*.

According to such configuration, it becomes possible to give the reference potential and a potential (driving signal) different from the reference potential to the common electrodes 43 and the individual electrodes 47 which are arranged on the pressurizing chambers 35, therefore the ink drops can be selectively ejected from the plurality of nozzles 33.

In the edge part of the via hole 45*h* which is arranged at each leadout electrode 47*b*, the projection portion 45*p* projecting to the FPC 27 side is arranged. The electrode body 47*a* which is arranged on the pressurizing chamber 35 is arranged so as to avoid the projection portion 45*p*. Therefore, it becomes harder to cause interference between the FPC 27 which is pushed upward by the projection portion 45*p* and the electrode body 47*a*. Note that, in this case, the electrode body 47*a* is one example of the external electrode.

The present invention is not limited to the above embodiments and modifications and may be executed in various ways.

For example, the printer (inkjet head) is not limited to the serial head type and off-carriage type. For example, the printer may be a line head type and/or on-carriage type as well. The piezoelectric actuator substrate is not limited to a unimorph type and for example may be a bimorph type as well. The configurations of the portions other than the inkjet head in the printer (for example conveying portion of media) may be suitable configurations other than the exemplified configurations. The media are not limited to paper either and may be media made of metal or resin.

The insulation layer exposed on the flexible board side and having via holes formed therein is not limited to the piezoelectric body and for example may be a reinforcing layer which covers the piezoelectric body and reinforces the piezoelectric actuator substrate. The via holes are not limited to ones for arranging via conductors and for example may be dedicated holes which are formed for forming the projection portions or may be openings in the above-explained reinforcing layer which are formed on the pressurizing chambers so that the bending of the piezoelectric body to the pressurizing chambers are not obstructed.

The plurality of connection patterns shown in the embodiments may be connected to each other to forma single connection pattern as well.

REFERENCE SIGNS LIST

5 . . . head, 23 . . . passage member, 25 . . . piezoelectric actuator substrate, 27 . . . FPC (flexible printed circuit), 33 . . . nozzle, 35 . . . pressurizing chamber, 45 . . . piezoelectric body (insulation film), 45*h* . . . via hole, and 45*p* . . . projection portion.

The invention claimed is:

1. An inkjet head comprising:

a passage member having a nozzle comprising a nozzle opening on a first surface, and a pressurizing chamber which is communicated with the nozzle and is positioned on a second surface opposite to the first surface, a piezoelectric actuator substrate which is superimposed on the passage member so as to cover the pressurizing chamber, and a flexible printed circuit which faces the piezoelectric actuator substrate from a side opposite to the passage member, wherein the piezoelectric actuator substrate has an electrically insulated layer which is exposed on a flexible printed circuit side, and the electrically insulated layer has a via hole opened toward the flexible printed circuit, and in a cross-sectional view of the piezoelectric actuator substrate including the via hole, the electrically insulated layer comprises a projection portion formed on one portion of an edge of the via hole, and the projection portion, formed on the one portion of the edge of the via hole, projects towards the flexible printed circuit higher than the electrically insulated layer formed at an other portion of the edge of the via hole.

2. The inkjet head as set forth in claim 1, wherein:

the electrically insulated layer comprises a piezoelectric body, and an external electrode is superimposed on a flexible printed circuit side of the piezoelectric body while avoiding the projection portion, and a top face of the projection portion is positioned nearer to the flexible printed circuit than a surface of the external electrode which faces the flexible printed circuit.

3. The inkjet head as set forth in claim 1, wherein:

the electrically insulated layer comprises a piezoelectric body, and an external electrode is superimposed on a flexible printed circuit side of the piezoelectric body while avoiding the projection portion, and a connection pattern is superimposed on the flexible printed circuit side of the piezoelectric body while avoiding the external electrode and connected through a bump to the flexible printed circuit, and the connection pattern has a connection pattern portion covering the projection portion, and a top face of the connection pattern portion is positioned nearer to the flexible printed circuit than a surface of the external electrode which faces the flexible printed circuit.

4. The inkjet head as set forth in claim 1, wherein the piezoelectric actuator substrate further has a via conductor which is arranged in the via hole and connects conductor layers, which are arranged on a front and back of the electrically insulated layer, with each other.

5. The inkjet head as set forth in claim 1, wherein in a top view of the electrically insulated layer including the via hole, the projection portion extends a length along the one portion of the edge of the via hole, the length having a range between ⅓ of a circumference of the edge of the via hole and ⅔ of the circumference of the edge of the via hole.

6. The inkjet head as set forth in claim 1, wherein in a top view of the electrically insulated layer including the via hole, the electrically insulated layer comprises a piezoelectric body, an internal electrode is superimposed on a passage member side of the piezoelectric body, a via conductor is arranged in the via hole and is connected to the internal electrode, and a connection pattern is superimposed on a flexible printed circuit side of the piezoelectric body and is connected to the via conductor, the projection portion extends a length along the one portion of the edge of the via hole, the length having a range between ⅓ of a circumference of the edge of the via hole and ⅔ of the circumference of the edge of the via hole, and the connection pattern, when viewed in a plan view, extends from a position superimposed on the via conductor to an outside of the via conductor through at least the other portion of the edge of the via hole at which the projection portion is not formed.

7. The inkjet head as set forth in claim 1, further comprising an external electrode superimposed on the electrically insulated layer, wherein a portion of a surface of the external electrode facing the flexible printed circuit and the flexible printed circuit are arranged at an interval of not more than 20 μm.

8. The inkjet head as set forth in claim 1, wherein a surface of the piezoelectric actuator substrate which is bonded to the passage member comprises a region having a recessed shape superimposed with the via hole.

9. A printer comprising the inkjet head as set forth in claim 1, a scanning portion which makes media and the inkjet head move relative to each other, and a control part which controls the inkjet head.

10. The inkjet head as set forth in claim 1, wherein the projection portion is provided on the one portion of the edge of the via hole on a surface of the electrically insulated layer facing the flexible printed board, and is not provided on the other portion of the edge of the via hole on the surface of the electrically insulated layer facing the flexible printed board.

11. The inkjet head as set forth in claim 1, wherein the piezoelectric actuator substrate comprises an elastic body positioned closer to the passage member than the electrically insulated layer, and a part of the elastic body on a piezoelectric actuator side overlaps with the via hole and protrudes toward an inside of the via hole.

12. The inkjet head as set forth in claim 1, wherein the piezoelectric actuator substrate comprises an elastic body positioned closer to the passage member than the electrically insulated layer, and the elastic body comprises a concave portion, on a passage member side, that overlaps the via hole.

13. An inkjet head comprising:

a passage member comprising a pressurizing chamber communicated with a nozzle;

a flexible printed circuit; and a piezoelectric actuator substrate between the passage member and the flexible printed circuit, and superimposed on the passage member so as to cover the pressurizing chamber, the piezoelectric actuator substrate comprising:

a piezoelectric body comprising a via hole having an opening facing the flexible printed circuit, the piezoelectric body comprising a projection portion, formed on one portion of an edge of the via hole, the projection portion projecting toward the flexible printed circuit higher than the piezoelectric body formed at an other portion of the edge of the via hole.

14. The inkjet head of claim 13, the piezoelectric actuator substrate further comprising:

an external electrode superimposed on a flexible printed circuit side of the piezoelectric body;

a common electrode superimposed on a passage member side of the piezoelectric body;

a connection pattern superimposed on the flexible printed circuit side of the piezoelectric body while avoiding the external electrode, the connection pattern connected to the flexible printed circuit through a bump;

a via conductor arranged in the via hole, and connected to the connection pattern on an other edge of the via hole, and connected to the common electrode through the via hole.

15. The inkjet head of claim 14, wherein a topmost surface of the projection portion extends above the via conductor, the connection pattern and the external electrode to provide a separation from the flexible printed circuit.

16. The inkjet head of claim 14, wherein the connection pattern has a connection pattern portion covering the projection portion, and a topmost surface of the connection pattern portion extends above the via conductor and the external electrode to provide a separation from the flexible printed circuit.

17. The inkjet head as set forth in claim 14, wherein the piezoelectric actuator substrate further comprises an elastic body positioned between the common electrode and the passage member, wherein a part of the elastic body overlaps with the via hole and protrudes toward an inside of the via hole.

18. The inkjet head as set forth in claim 14, wherein the piezoelectric actuator substrate further comprises an elastic body positioned between the common electrode and the passage member, wherein a part of the elastic body overlaps with the via hole and comprises a concave portion on a passage member side that overlaps the via hole.

19. A printer comprising:

the inkjet head as set forth in claim 13, a scanning portion moving relative to the inkjet head, and a control part which controls the inkjet head.

* * * * *